United States Patent [19]

Ström et al.

[11] Patent Number: 4,979,575

[45] Date of Patent: Dec. 25, 1990

[54] METHOD OF DRILLING A HOLE-IN A ROCK

[75] Inventors: Rolf Ström, Tampere; Veijo Nurmi, Ylöjärvi; Risto Wisakanto, Tampere, all of Finland

[73] Assignee: Oy Tampella Ab, Tampere, Finland

[21] Appl. No.: 359,520

[22] Filed: Jun. 1, 1989

[30] Foreign Application Priority Data

Jun. 3, 1988 [FI] Finland ..... 882637

[51] Int. Cl.[5] ..... B21J 7/00

[52] U.S. Cl. ..... 173/001; 175/45; 299/1

[58] Field of Search ..... 173/1, 39, 43, 4, 38, 173/44; 299/1, 10; 175/40, 45; 408/10, 12

[56] References Cited

U.S. PATENT DOCUMENTS 4,113,033 9/1978 Linblad ..... 173/1

4,498,544 2/1985 Molin ..... 173/43 X 4,537,263 8/1985 Bjor ..... 173/1

*Primary Examiner*—Frank T. Yost

*Assistant Examiner*—William Fridig, Jr.

*Attorney, Agent, or Firm*—Ladas & Parry

[57] ABSTRACT

A method and an arrangement for drilling a hole in a rock (6), wherein a preliminary hole is drilled first, whereafter the drilling is interrupted. Joints between a drill boom (2) and a feeding beam (5) and/or the feeding beam (5) in its longitudinal direction are released so as to move freely in order that the boom (2) and the feeding beam (5) would take a substantially strainless position and the angles ($\alpha$, $\beta$) of the joints and the position of the feeding beam (5) and the drill rod are measured. Thereafter the direction and distance from the preliminary hole (C) to the terminal point (B) of the originally designed hole is computed, and the drilling of the hole is completed.

3 Claims, 2 Drawing Sheets

Figure 1A:
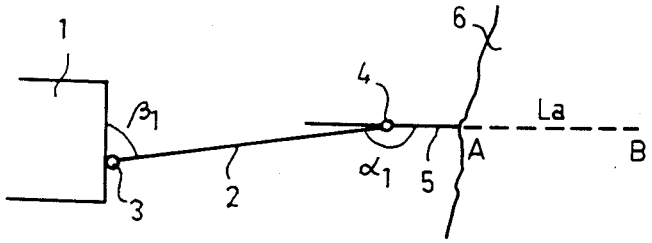
Figure 1B:
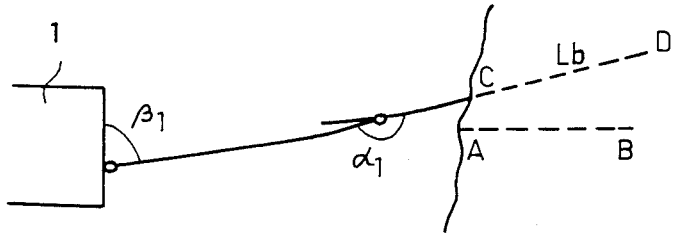
Figure 1C:
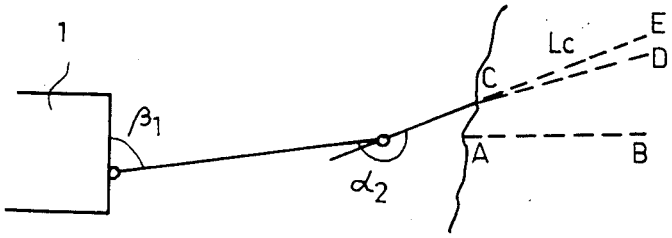
Figure 1D:
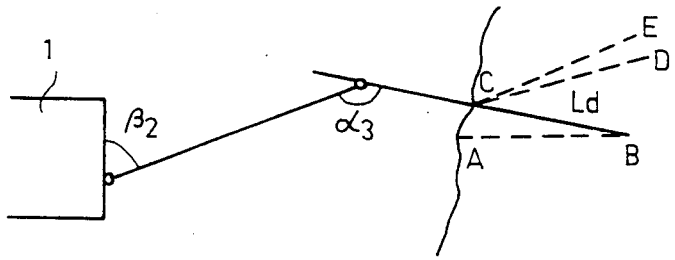

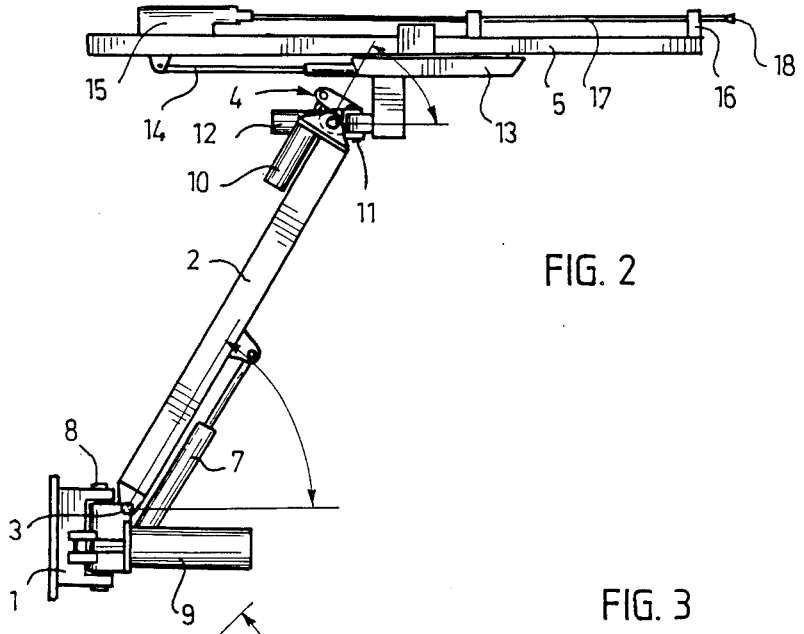
FIG. 2
FIG. 3
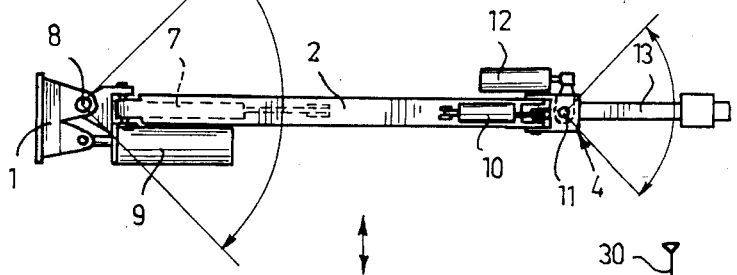
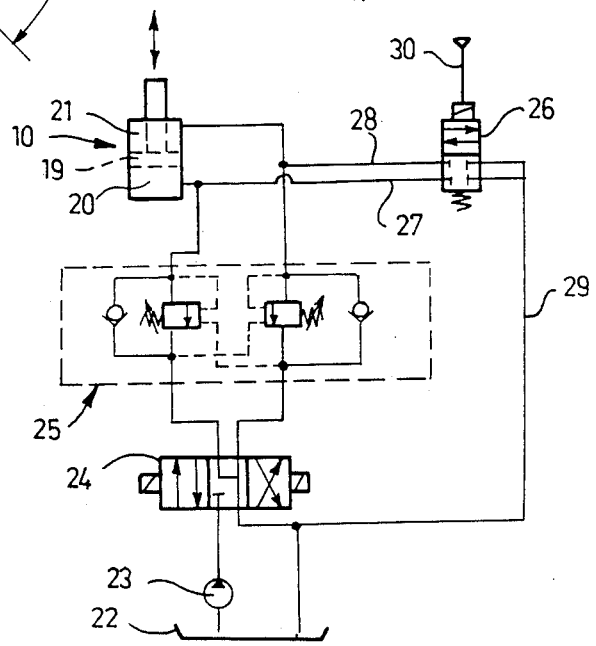
FIG. 4

METHOD OF DRILLING A HOLE-IN A ROCK

The invention relates to a method of drilling a hole in a rock by means of a drilling equipment comprising a boom pivotable on joints; a feeding beam mounted in the end of the boom pivotably on joints with respect to the boom and displaceably in its longitudinal direction with respect to the boom; a drill rod parallel with and longitudinally displaceable with respect to the feeding beam, the drill rod being provided with a drill bit; angle gauges provided in each joint for measuring turning angles for said joints; gauges for measuring the longitudinal position of the feeding beam with respect to the end of the boom and for measuring the longitudinal position of the drill rod with respect to the feeding beam; and control means connected to the gauges for controlling the movements of the boom and the feeding beam and the drilling process; in which method, in order that the terminal end of the drill hole would be positioned substantially at a desired point within the rock, the drill rod is oriented in a predetermined direction concentrically with the planned drill hole by turning the boom and/or the feeding beam with respect to the boom on the joints and the drilling process is initiated at a predetermined point by displacing the feeding beam towards the rock until it makes contact with the surface of the rock, whereafter the drill rod is fed onwards and the drilling process is continued until the terminal end of the hole is substantially at the predetermined point, all the joints and the feeding beam in its longitudinal direction being locked substantially stationary during the drilling process. The invention is further concerned with an arrangement for the realization of a method according to claim 1 by a drilling equipment comprising a boom pivotable by power devices on joints; a feeding beam mounted in the end of the boom pivotably by power devices on joints with respect to the boom and displaceable by a power device in its longitudinal direction with respect to the boom; a drill rod parallel with and longitudinally displaceable with respect to the feeding beam, the drill rod being provided with a drill bit; angle gauges provided in each joint for measuring turning angles for said joints; gauges for measuring the longitudinal position of the feeding beam with respect to the end of the boom and for measuring the longitudinal position of the drill rod with respect to the feeding beam; and control means connected to the gauges for controlling the movements of the boom and the feeding beam and the drilling process, all the joints and the feeding beam in its longitudinal direction being locked substantially stationary by the power devices during the drilling process.

On initiating the drilling of a hole in a rocky wall, the drill bit often slips in the sideward direction with respect to the surface of the rock from the originally designed point of contact before the hole is formed. This is due to the fact that the surface of the rock is mostly uneven and inclined in various ways, whereby there occurs a force component tending to turn the drill bit in the sideward direction due to the feed force and the rotation of the drill. This component bends the boom, the feeding beam, and the drill rod. This, in turn, results in that when the drilling is continued, the drill rod is at an angle to the originally designed drilling direction and at a distance therefrom. So the hole will not have the designed location, which degrades the cleavage at blasting and possibly causes unnecessary excavation work. This phenomenon is a marked drawback particularly at modern excavation of tunnels and the like, which aims at great accuracy and efficiency, so it should be avoided.

In order to keep the drill rod in the desired direction, it is known from British Published Specification No. 2,103,969 to define a so called coefficient of rigidity for each component of the drilling equipment, such as the boom and the feeding beam. The angle values of each joint are then corrected as a function of the feed force of the drill rod so as to keep the drill rod in its originally designed location However, the solution of this citation does not in any way take into account the sideward displacement of the drill rod along the surface of the rock, wherefore it is not able to compensate for the incorrect direction and location of the hole resulting from such displacement.

U.S. Patent Specification No. 3,724,559, in turn, discloses a solution in which the bending of the boom due to the feed force and the resultant bending of the drill rod are detected by a special detector which controls the turning of the boom so that the drill rod remains substantially straight throughout the drilling process. Errors caused by sideward displacement are not taken into account in this citation, either, so they cannot be compensated for.

U.S. Patent Specifications No. 3,791,460 and 4,343,367, in turn, teach how the boom system of a rock drilling equipment is directed automatically so as to bring the drill rod into the right position on initiating the drilling Neither citation suggests how the created errors and the deviations caused by the sideward displacement of the drill rod could be corrected.

The object of the present invention is to provide a method and an arrangement in which errors caused by the displacement of the drill rod relative to the surface of the rock and the bending of the drilling boom are taken into account and compensated for so that the terminal end of the drilled hole will be positioned at the predetermined point. The method according to the invention is characterized by first drilling a preliminary hole of a length such that the drill bit stays therein substantially immovable with respect to the surface of the rock in the direction of the surface; releasing a required number of joints between the boom and the feeding beam and/or the feeding beam in its longitudinal direction so that the boom and the feeding beam rest freely and substantially without strain while the drill bit is still positioned in the preliminary hole; measuring the strainless positions of the released joints and/or releasing the feeding beam; computing, on the basis of the strainless positions, the dimensions of the boom and the feeding beam, and the feeding length of the drill rod the actual position of the preliminary hole and the direction required for completing the drilling of the hole from the preliminary hole to the desired terminal point of the hole; and orienting the drill rod in the computed direction while keeping the drill bit in the preliminary hole by turning the boom and/or the feeding beam on the joints and/or by displacing the feeding beam in its longitudinal direction, whereafter the drilling process is continued up to the desired terminal point of the drill hole.

The basic idea of the invention is that a preliminary hole is first drilled in the rock, irrespective of how the drill bit is displaced relative to the surface of the rock aside from the designed drilling point. The formed drill hole is then used as a checkpoint, and its position is determined by releasing the joints between the boom and the feeding beam, so that while the drill bit stays in the preliminary hole, the boom and the feeding beam are straightened substantially straight, being simultaneously pivoted on said joints. The position of the boom and the feeding beam with respect to each other can thereby be determined by gauges detecting the angles of the joints, on the basis of which the actual position of the preliminary hole can be computed using the known dimensions of the boom and possibly the lengths of the longitudinal displacing movement of the feeding beam and the feed movement of the drill rod. Furthermore, it can be computed on the basis of the position of the preliminary hole in what direction the drilling of the drill hole has to be carried out from the preliminary hole and how long the hole should be in order that its terminal end would be positioned as originally designed. An advantage of the invention is that the drill hole will be positioned as accurately as possible for the blasting, so that the excavation work will be accurate and efficient. Since the position of the inlet end of the hole is not of any greater importance for the blasting, the blasting charge being positioned at the bottom of the hole, the blasting accuracy thus obtained is considerably improved as compared with previous blasting accuracy. This is due to the fact that while in prior art solutions the inlet end of the hole is relatively close to the intended inlet end, the terminal end of the hole is positioned at a considerable distance from the intended terminal end. A further advantage of the invention is that the end result can be obtained almost solely by existing control and measuring devices and no highly expensive modifications and investments are required.

The arrangement of the invention is characterized in that it further comprises means for releasing at least the joints between the boom and the feeding beam and/or the feeding beam in its longitudinal direction so that they move freely.

The basic idea of the arrangement is that, as distinct from the prior art, where a power device provided in each joint or displacing means interconnects the boom portions on opposite sides of the joint or the boom and the feeding beam, or correspondingly, in the displacing means the cradle of the feeding beam and the feeding beam, so that the power device is immovable at the normal state and similarly each joint as well as the feeding beam is rigid and immovable, the joints and the displacing means can be released so as to pivot and move freely by connecting the power devices so that they move freely. In this way the feeding beam and the boom rest substantially without any strains so that only the force of gravity acts thereon. An advantage of the arrangement is that it utilizes the existing equipment to a very great extent; only a few components have to be added so as to be able to carry out the drilling rapidly and in such a way that the terminal end of the drill hole will be positioned at a desired point.

The invention will be described in greater detail in the attached drawings, wherein FIGS. 1*a*–1*d* illustrate schematically the realization of the method according to the invention;

FIGS. 2–3 are schematical, more detailed views of a drill boom and a feeding beam attached thereto as well as of the joints and displacing means required for realizing the method; and FIG. 4 shows a hydraulic connection for releasing, in a boom system provided with a hydraulic power device, the hydraulic cylinders of the joints to be released so that they move freely as required in the invention.

FIG. 1*a* is a schematical view of a boom 2 attached to a carrier 1 for a drilling equipment, the boom being pivotable on a joint 3 relative to the carrier. A feeding beam 5 is mounted in the other end of the boom 2 so as to be pivotable on a joint 4, a drilling machine and a drill rod provided with a drill bit (not shown) being displaceable along the feeding beam. On initiating the drilling, the boom 2 is pivoted on the joint 3 and the feeding beam on the joint 4 until the feeding beam 5 is in parallel with the designed hole, that is, in parallel with a line La going from point A to point B, and the drill rod is substantially concentric with a line L. At this stage, an angle $\alpha 1$ is defined between the feeding beam 5 and the boom 2 and an angle $\beta 1$ between the boom 2 and the carrier 1. Thereafter the feeding beam 5 is displaced forwards in its longitudinal direction by displacing means (not shown) positioned between the feeding beam 5 and the joint 4 until the forward end of the feeding beam 5 makes contact with the surface of a rock 6. If the surface of the rock 6 is inclined, as in FIGS. 1*a*–1*d*, the feed force and the rotation of the drill cause the drill bit at the end of the drill rod to be displaced along the surface to a point at which the sideward displacing force and the force turning in the opposite direction due to the bending of the drill boom 2 and the feeding beam 5 are at equilibrium. While the drill bit is displaced in the sideward direction, the feeding beam 5 is further pushed on by the displacing means in order that it would be positioned against the rock 6 as steadily as possible. After the sideward displacement has ended, the drill bit is positioned at point C, and the boom 2 and the feeding beam 5 are bent from point A towards point C, as appears from FIG. 1*b*. For the sake of clarity, the bending as well as the movements of the boom 2 and the feeding beam 5 are shown exaggerated in FIGS. 1*a*–1*d*. At this stage, the angles 1 and 1 are as wide as initially, the turning being based solely on the bending of the boom 2 and the feeding beam 5. After the sideward movement of the drill bit has ended, the proper drilling process is initiated, and the drill bit penetrates the rock at point C, whereby the drill rod extends in parallel with a line Lb, going from point C to point D. If the drilling would now be continued in a conventional way, the drill hole would be formed between point C and point D. The terminal end of the drill hole at point D would thereby deviate considerably from the intended position at point B.

In the invention, the joint 4 between the boom 2 and the feeding beam 5 is released so that it moves freely after the drill bit has penetrated the rock 6 to such an extent that it stays immovable in the sideward direction relative to the surface of the rock 6. Thereby the drill boom 2 and the feeding boom 5 take the position shown in FIG. 1*c*. For this purpose, the drilling can be interrupted, e.g., by stopping the feeding of the drill rod along the feeding beam or by stopping both the feeding and the rotation. The feeding beam 6 and the drill rod, respectively, are thereby in a more inclined position than previously with respect to the desired drilling position, and the direction of the drill rod is from point C along a line Lc to point E. After the boom 2 and the feeding beam 5 have taken the free position, the angle between the boom 2 and the carrier 1 is still $\beta 1$, while the angle between the feeding beam 5 and the boom 2 differs from its earlier value, being $\alpha 2$. The actual turning angle $\alpha 2$ of the joint 4 can now be measured by means of a gauge belonging to the joint 4 while the boom 2 and the feeding beam 5 are substantially strainless. Correspondingly, the position of the feeding beam 5 with respect to the end of the boom 2 is measured by a gauge connected to the displacing means of the feeding beam 5. The position of point C, that is, the point at which the drilling of the hole is to be initiated, can now be computed using the known geometry and dimensions of the boom system and the feeding beam. This is carried out simply by means of a microprocessor comprised in the drilling equipment and intended for the control of the boom system and the drilling process in general.

After the position of the point C has been computed, it can be correspondingly computed simply by means of the microprocessor, what is the direction of the drill hole from point C to point B required in order to get the terminal end of the drill hole substantially at the intended point B. At the same time the length of the drill hole from point C to point B can be computed. Thereafter the feeding beam 5 is reoriented by turning the boom 2 relative to the carrier 1 on the joint 3 at the angle $\beta 2$ and further by turning the feeding beam 5 relative to the end of the boom 2 on the joint 4 at an angle $\alpha 3$, while the drill bit is all the time kept in the preliminary hole at point C. The feeding beam 5 is now oriented so that the drill rod extends in parallel with a line Ld between point C and point B, and the feeding beam 5 is pushed in the longitudinal direction in contact with the surface of the rock 6, whereafter the final hole is drilled from point C to point B.

In FIGS. 1*a*–1*d*, the method is illustrated in a single plane for the sake of clarity. Consequently, as to the joints on which the boom 2 and the feeding beam 5 are pivotable, the figures show only joints perpendicular to this plane. However, a three-dimensional application is likewise possible, using angles and lengths in two planes transverse to each other, preferably perpendicular to each other, for detecting the movements and changes of the boom structures known per se in different directions. Thereby both the boom 2 and the feeding beam 5 are pivotable on joints perpendicular to both planes. Correspondingly, the angle measurement and the computation of the position of the preliminary hole and the direction and distance of the hole to be drilled are carried out with respect to both planes so that the drill hole will be defined as desired in a three-dimensional set of coordinates so that the definition corresponds to the actual situation.

FIGS. 2 and 3 show a typical drill boom in a rock drilling equipment, in which the boom 2 is mounted in the carrier 1 so as to be pivotable on the joint 3 by a power device 7 and on the joint 8 by a power device 9. The feeding beam 5 is mounted at the other end of the boom 2 so as to be pivotable on the joint 4 by a power device 10 and on a joint 11 by a power device 12. A cradle 13 is provided between the feeding beam 5 and the joint 11, the feeding beam 5 being longitudinally displaceable along the cradle 13 by a power device 14. Above the feeding beam, there are provided a drilling machine 15 and a drill rod 17 extending from the drilling machine through a centralizer 16 positioned at the forward end of the feeding beam, the drill rod being provided with a drill bit 18 at its end. The boom 2 may further comprise a so called zoom, that is, means for extending the boom 2 in its longitudinal direction. Such means, however, are known per se and therefore will not be described in any greater detail.

When applying the method of the invention by the device of FIGS. 2 and 3, the boom 2 is pivoted on the joints 3 and 8 and the feeding beam 5 is pivoted on the joints 4 and 11 in such a manner that the feeding beam 5 is so positioned that the drill rod 17 is parallel with and substantially concentric with the intended drill hole having a predetermined direction and length. At this stage, the joints 4 and 8 are locked substantially immovable after the turning, since the stop valves of the power devices 10 and 12 prevent, in a manner known per se, the flow of the hydraulic fluid from one cylinder chamber to another. Due to the incompressibility of the fluid, the pistons are substantially unable to move in their longitudinal direction. In principle, the feeding beam can thereby be pivoted on the joints only to such an extent as is allowed by the resiliency of the materials, which is substantially insignificant in view of the invention. Thereafter the feeding beam 5 is displaced by the displacing means 14 onwards relative to the cradle 13 in the longitudinal direction of the feeding beam 5, so that the forward end of the feeding beam 5 makes contact with the rock wall so that the drill bit 18 is positioned substantially at the intended point for initiating the drilling of the hole. Thereafter the drilling is initiated, whereby the feeding beam 5 and the boom 2 are bent while the drill bit moves along the surface of the rock 6. If need be, the feeding beam 5 can be continually pushed in its longitudinal direction onwards, so that it tends to follow the surface of the rock 6, too, while the drill bit 18 is displaced in the sideward direction, until the sideward displacement ends, and the drill bit 18 penetrates the rock 6, thus forming the preliminary hole. Thereafter the drilling process is preferably interrupted so that the feeding movement of the drill rod 17 along the feeding beam 5 is stopped or both the feeding movement and the rotation of the drill rod 17 are interrupted. In both cases, this implies that the drill rod 17 is released from the feed force acting thereon. Thereafter the power devices 11 and 12 of the joints 4 and 11, that is the pressure fluid cylinders, typically hydraulic cylinders, are connected so that the pressure fluid can flow freely from one cylinder space to another so that the pistons can move freely under the influence of the forces created by the strains caused by the bending of the boom 2 and the beam 5, until the boom 2 and the feeding beam 5 are substantially strainless. Gauges are provided in the joints 3, 8, 4 and 11, in the displacing means 14 of the feeding beam and in the longitudinal displacing means possibly provided in the boom 2, for observing their movement, respectively. The gauges indicate the angles and the longitudinal displacements on the basis of which the direction and position of the feeding beam 5 and the drill rod 17, respectively, can be determined. Since the coordinate and direction data recorded at the design stage in the microprocessor of the drilling equipment concerning the drill hole are those on the basis of which the microprocessor controls the passing of the boom 2 and the feeding beam 5 into the original position for initiating the drilling, it is possible to determine on the basis of the angle values obtained after the releasing of the power devices 10 and 12, where the formed preliminary hole is positioned. In addition, it is possible to compute, on the basis of the values of this hole, the direction and the length values required for the new drill hole, whereafter the boom is pivoted on the joints 3 and 8 by means of the power devices 7 and 9 and the feeding beam 5 is pivoted on the joint 4 and 11 by means of the power devices 10 and 12 while, if required, the feeding beam 5 is displaced longitudinally by the displacing means 14 and the boom is possibly extended by means of longitudinal displacing means not shown so that the drill bit 18 remains all the time in the drilled preliminary hole. After the drill rod 17 has been reoriented so as to be in parallel with the recomputed hole, the drill bit 18 being already positioned in the preliminary hole, the feeding beam 5 is pushed against the rock and the drilling of the hole is completed.

FIG. 4 shows a hydraulic connection by means of which the hydraulic cylinders can be connected so as to move freely for applying the method. The cylinder 10 comprises a piston 19 which divides the inner space of the cylinder 10 into two chambers 20 and 21. From a pressure fluid tank 22, pressure fluid is pumped when required by means of a pump 23 through a reversing valve 24 into a pressure-controlled stop valve 25 which closes channels to the chambers 20 and 21 when the feeding of the pressure fluid is interrupted, thus preventing the flow of the pressure fluid into the chambers or away therefrom. The structure and operation of these components are known per se, wherefore they will not be described more closely herein.

A release valve 26 connected to the chambers 20 and 21 through separate channels 27 and 28, respectively, is used for connecting the cylinder 10 so that it moves freely. The valve 26 is also connected to the pressure fluid tank 22 through a separate channel 29. The valve 26 is controlled by a separate signal through a line 30, whereby the control can be carried out, e.g., by means of an electric signal, or the valve can be controlled by a pressure fluid, depending on the valve to be used. When the valve 26 is switched on, it connects the chambers 20 and 21 of the cylinder 10 through the channels 27 and 28 in communication with each other while it also connects both chambers in communication with the pressure fluid tank 22. This is necessary because volume changes in the chambers 20 and 21 differ from each other with the same stroke length of the piston 19 due to the influence of the piston driver of the piston 19; depending on the direction of movement, pressure fluid either has to be removed from the cylinder 10 or more pressure fluid has to be introduced. With this connection, the pressure fluid may flow freely in either direction according to the requirements in each particular case, and the movement of the cylinder 10 is thus free.

The hydraulic connection shown in FIG. 4 comprises one cylinder 10 only. Correspondingly, a release valve can be provided for each cylinder possibly to be released as well as for each power device such as a hydraulic feeding motor. The release valve connects the chambers of the cylinder and the pressure fluid tank with each other in response to a control signal. Each valve can thereby be arranged to operate simultaneously or one or more at a time, as required.

In the above description, only a few examples of the method and the arrangement according to the invention have been set forth, and the invention is in no way restricted thereto. The invention can be similarly applied within the scope of the claims to drilling equipments of all types as well as to drilling booms used therein, including various rotatable booms and feeding beams as well as booms and feeding beams with adjustable length. Correspondingly, not only the joints between the feeding beam and the boom are suitable to be released but also joints between the boom and the carrier and the rotation means of the boom or the feeding beam can be used for the purpose according to the invention. In the method, the joints can be released one by one or several at a time in a predetermined way. When applying the invention, the releasing stage can be effected also during the rotation of the drill even though the feeding of the drill rod is interrupted. Furthermore, the drilling process can be interrupted and restarted in a known manner at another point if the measurements carried out after the releasing show that the position of the preliminary hole deviates to such an extent from the planned position that the finished hole would be too much inclined in view of the structure of the boom or the drilling of other holes or it might hamper the drilling of the other holes. On releasing the joints it is, of course, possible that the drill bit will not stay in the preliminary hole but slips away therefrom so that the feeding beam begins to turn freely under the influence of the force of gravity. In such a case, the gauges detect the exceptionally rapid movement, whereby the joints are again stiffened so that they can be controlled, and the drilling process is restarted in a usual way. Furthermore, even though the invention has been described with reference to hydraulically operated booms, the method of the invention can be similarly applied in some other way and in connection with drilling booms realized in some other way using power means of some other type.

We claim:

1. A method of drilling a hole in a rock (6) by means of a drilling equipment comprising a boom (2) pivotable on joints (3, 8); a feeding beam (5) mounted in the end of the boom (2) pivotably on joints (4, 11) with respect to the boom and displaceably in its longitudinal direction with respect to the boom; a drill rod (17) parallel with a longitudinally displaceable with respect to the feeding beam (5), the drill rod being provided with a drill bit (18); angle gauges provided in each joint (3, 34, 8, 11) for measuring turning angles ($\alpha$, $\beta$) for said joints (3, 4, 8, 11); gauges for measuring the longitudinal position of the feeding beam (5) with respect to the end of the boom (2) and for measuring the longitudinal position of the drill rod (17) with respect to the feeding beam (5); and control means connected to the gauges for controlling the movements of the boom (2) and the feeding beam (5) and the drilling process; in which method, in order that a terminal end of the hole would be positioned substantially at desired point within the rock (6), the drill rod (17) is oriented in a predetermined direction concentrically with the planned hole by turning at least one of the boom (2) and the feeding beam (5) with respect to the boom (2) on the joints (3, 4, 8, 11) and the feeding beam (5) in its longitudinal directing being locked substantially stationary during the drilling process, characterized by:

first drilling a preliminary hole of a length such that the drill bit (18) stays therein substantially immovable with respect to the surface of the rock (6) in the direction of the surface;

releasing at least one of (a) a required number of the joints (4, 11) between the boom (2) and the feeding beam (5) and (b) the feeding beam (5) in its longitudinal direction so that the boom (2) and the feeding beam (5) rest in strainless positions freely and substantially without strain while the drill bit (18) is still positioned in the preliminary hole;

measuring the strainless positions of the joints (4, 11) and feeding beam (5) while so released;

re-orienting the drill rod (17) in a direction based on the strainless positions, the dimensions of the boom (2) and the feeding beam (5), and the feeding length of the drill rod (17), and an actual position of the preliminary hole and a direction required for completing the drilling of the hole from the preliminary hole to the desired point while keeping the drill bit (18) in the preliminary hole by at least one of (a) turning at least one of the boom (2) and the feeding beam (5) on the joints (3, 4, 8, 11) and (b) displacing the feeding beam (5) in its longitudinal direction, whereafter the drilling process is continued up to the desired point.

2. A method according to claim 1, wherein the releasing is characterized in that the joints (4, 11) and the feeding beam in its longitudinal direction are released one by one in a sequence until the strainless positions are obtained.

3. A method according to claim 1 wherein the releasing is characterized by additionally releasing the drill rod (17) from the feed force acting thereon.

* * * * *